US008474284B2

(12) United States Patent
Rush et al.

(10) Patent No.: US 8,474,284 B2
(45) Date of Patent: Jul. 2, 2013

(54) DECORATIVE BRACELET WITH TRADABLE TOKEN INSETS

(76) Inventors: Ryan Rush, Lutherville, MD (US); Doug Meagher, Severn, MD (US)

( * ) Notice: Subject to any disclaimer, the term of this patent is extended or adjusted under 35 U.S.C. 154(b) by 117 days.

(21) Appl. No.: 13/224,833

(22) Filed: Sep. 2, 2011

(65) Prior Publication Data

US 2013/0055760 A1 Mar. 7, 2013

(51) Int. Cl.
*A44C 5/00* (2006.01)

(52) U.S. Cl.
USPC ..... 63/40; 63/3; 63/5.1; 63/11; 63/33; 273/148 R

(58) Field of Classification Search
None
See application file for complete search history.

(56) References Cited

U.S. PATENT DOCUMENTS

| | | | | | |
|---|---|---|---|---|---|
| 1,701,610 | A * | 2/1929 | Forstner | 63/4 |
| 2,145,071 | A * | 1/1939 | Cave | 63/3 |
| 2,413,541 | A * | 12/1946 | Brady | 63/3 |
| 3,670,525 | A * | 6/1972 | Mulligan | 63/23 |
| 4,827,575 | A * | 5/1989 | Delaney | 63/3 |
| 5,081,852 | A * | 1/1992 | Cox | 63/3 |
| 5,806,346 | A * | 9/1998 | Schlinger et al. | 63/40 |
| D472,840 | S * | 4/2003 | Visick | D11/3 |
| D503,646 | S * | 4/2005 | Rapport | D11/3 |
| 7,028,507 | B2 * | 4/2006 | Rapport | 63/3 |
| D617,231 | S * | 6/2010 | Adamson | D11/4 |
| 7,921,019 | B2 * | 4/2011 | Ryan et al. | 705/1.1 |
| 8,371,141 | B2 * | 2/2013 | Richmond | 63/29.2 |
| 2005/0166638 | A1 * | 8/2005 | von Peterffy-Rolff de Erney | 63/40 |
| 2008/0016914 | A1 * | 1/2008 | Golan | 63/40 |
| 2010/0144429 | A1 * | 6/2010 | Ryan et al. | 463/29 |

* cited by examiner

*Primary Examiner* — Jack W. Lavinder
(74) *Attorney, Agent, or Firm* — Ober, Kaler, Grimes & Shriver; Royal W. Craig

(57) ABSTRACT

A molded silicone rubber bracelet having a plurality (preferably three) specially-formed receptacles for seating and retaining the same number of play-value tokens in a convenient manner for trading and/or playing games. The tokens bear different graphic indicia but all have a uniform size and circular (or alternately-shaped) two-tier cross-section that allows them to be held captive in three outwardly-disposed and uniformly-spaced receptacles in the bracelet in tongue-in-groove manner. Since the tokens are easily removable/replacable/tradable, they can be traded at will for other tokens and/or used for playing a game. The token-carrying functionality of the bracelet coupled with its ornamental token-displaying appearance capitalizes on the popularity of conventional rubber wristbands as well as social trading interaction, resulting in great appeal to teens and youth.

5 Claims, 4 Drawing Sheets

DECORATIVE BRACELET WITH TRADABLE TOKEN INSETS

BACKGROUND OF THE INVENTION

1. Field of the Invention

The present invention relates generally to youth-oriented jewelry and, more particularly to a silicon rubber bracelet incorporating removable/replaceable and tradable token-insets for play value.

2. Description of the Background

There are many different games that involve the trading of cards and/or tokens, and teens and young adults have long used collectibles as a means of socializing through trading.

A trading card (or collectible token) is a small card or chip which usually contains an image of a certain brand logo, person, place or thing and a short description of the picture (statistics, trivia, etc.) There is wide variation among different types of cards and tokens available. Trading cards are traditionally associated with sports, and baseball cards are especially well-known. However, there are many non-sports trading cards featuring cartoons, comic book characters, television series, or movie stills. Trading cards are often used to play various games. In the 1990s, cards designed specifically for playing games became very popular using fantasy duels as the basis for game play. For example, Pokémon™ is a Nintendo franchise role-playing game of Japanese origin. Players collect and trade cards representing a myriad of Pokemon animals, each having different powers and each having a different intrinsic value. Yu-Gi-Oh™ is very similar in concept.

Sports trading cards are usually sold in small packets and cards contained in the packet are randomly selected when packed. A certain number of unique cards create a set of cards and the aim is to collect an entire team, all-star players, etc. The popularity of trading cards/tokens has remained fairly constant for nearly a century.

On the other hand, a relatively new pursuit of teens and young adults is the wearing of silicone wristbands/rubber bracelets. Branded rubber wristbands have become a staple jewelry article for teens and young adults, the popular Lance Armstrong LIVESTRONG™ yellow rubber bracelets being just one example. The wrist bands are often associated by color with a charitable cause or organization, and wearers are proliferating especially in the teen and young adult age groups.

It would be greatly desirable to provide a decorative rubber bracelet with a plurality of tradable insets to capitalize on the popularity of both of the above-described products.

SUMMARY OF THE INVENTION

It is, therefore, a primary object of the present invention to provide a decorative rubber bracelet having a plurality of removable/replacable/tradable token insets.

Another object of the present invention is to provide a decorative rubber bracelet having a plurality (preferably three) token insets for trading and/or playing a game.

It is still another object of the present invention to provide a silicone rubber bracelet with a capacity for holding three or more removable/replacable/tradable token insets in an ornamental yet highly secure manner.

In accordance with the foregoing objects, the present invention is a molded silicone rubber bracelet having a plurality (preferably three) specially-formed receptacles for seating and retaining three play-value tokens in a convenient manner for trading and/or playing games. The tokens bear different graphic indicia but all have a uniform size and circular shape, and a two-tier cross-section including a base of slightly larger diameter than the top section. Three tokens fit into conforming receptacles in the bracelet in tongue-in-groove manner. The tokens bear different graphic indicia but all have a uniform size and circular shape, and a two-tier cross-section including a base of slightly larger diameter than the top section.

The bracelet is an integrally-molded flexible rubber band having a plurality (preferably three) outwardly-disposed and uniformly-spaced circular faces, the center-axes of the circular faces being arrayed at 120 degree angles. Each circular face is defined by a recessed circular receptacle defining an open-faced cavity bounded by a solid back wall, and sidewalls having a first diameter conforming to the diameter of the base of the tokens, plus an overhanging lip having a second smaller diameter conforming to the diameter of the top section of the tokens. The overhanging lip flexibly joined orthogonally to the sidewalls, which are in turn flexibly joined orthogonally to the backwall to define the inner cavity, while the outward-facing edges of the junction (defining the outer margins of the faces) are molded with a curvilinear contour so as to present a smooth flush appearance with the tokens held captive in the cavities. The circular shape of the tokens/receptacles allows rotation of the tokens within the bracelet and hence reorientation of the graphic design as desired by the wearer. Each circular face of the bracelet is contoured into the smaller band, giving the general appearance of a watch-band having three rounded faces.

The tokens may be metallic or plastic-molded discs each bearing different graphic indicia representing an image of a certain brand logo, person, place or thing, and may contain on the back a short description of the picture (statistics, trivia, etc.). The token images may have intrinsic play-value and may be traded or used to play various games in the manner of Pokémon™ or Yu-Gi-Oh™. Since the tokens are easily removable/replacable/tradable, they can be traded at will for other tokens and/or used for playing a game. The token-carrying functionality of the bracelet coupled with its ornamental token-displaying appearance capitalizes on the popularity of conventional rubber wristbands as well as social trading interaction, resulting in great appeal to teens and youth.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a silicon rubber bracelet incorporating removable/replaceable and tradable token-insets for play value.

Figure 1:
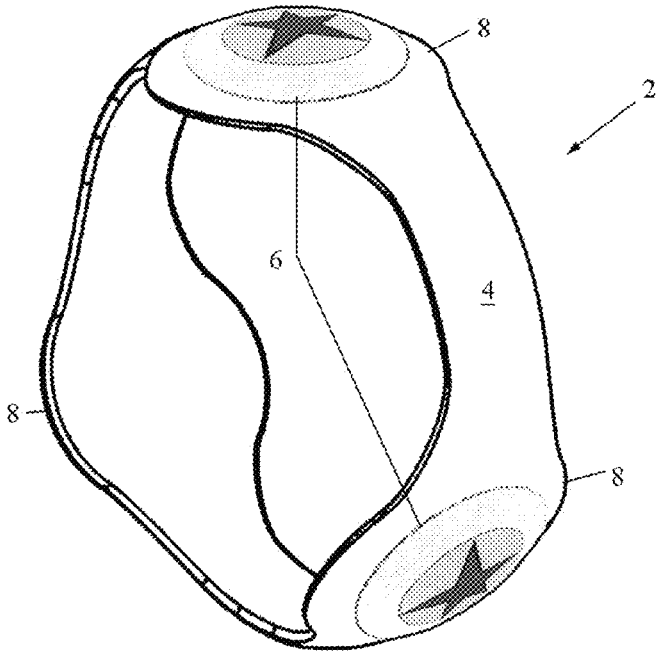
FIG. 1 is a side perspective view of the decorative bracelet with tradable token insets 2 according to a preferred embodiment of the present invention.
Figure 2:
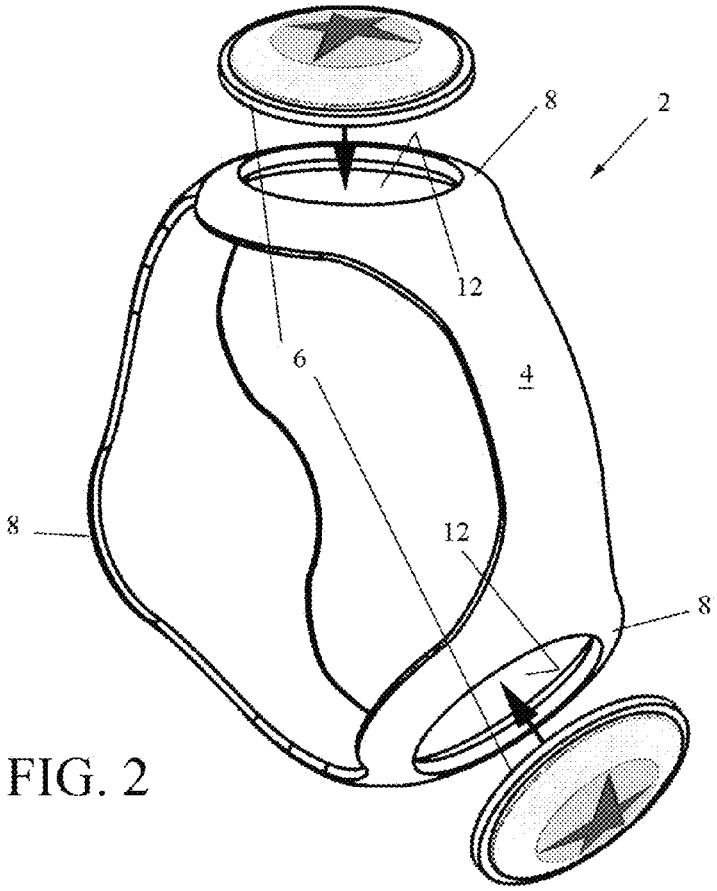
FIG. 2 is an exploded perspective view of the decorative bracelet with tradable token insets 2 as in FIG. 1.

As seen in FIGS. 1-2, the device 2 generally comprises a unitary flexible molded silicon rubber bracelet 4 incorporating a plurality (preferably three) removable/replaceable and tradable token-insets 6 each having play value, and which can be traded at will for other tokens and/or used for playing a game.

The bracelet 4 is an integrally-molded flexible silicone-rubber band having three outwardly-disposed and uniformly-spaced circular faces 8, the center-axes of the circular faces being arrayed at 120 degree angles relative to one another.

Figure 3:
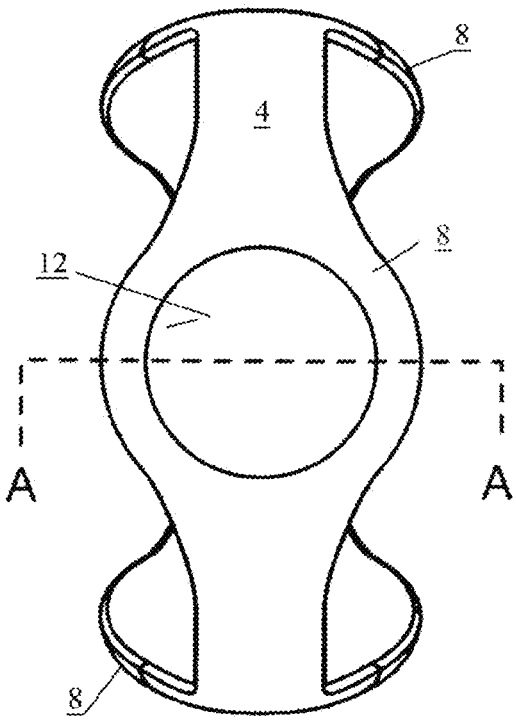
FIG. 3 is a side view of the decorative bracelet 4 with tokens 6 removed.
Figure 4:
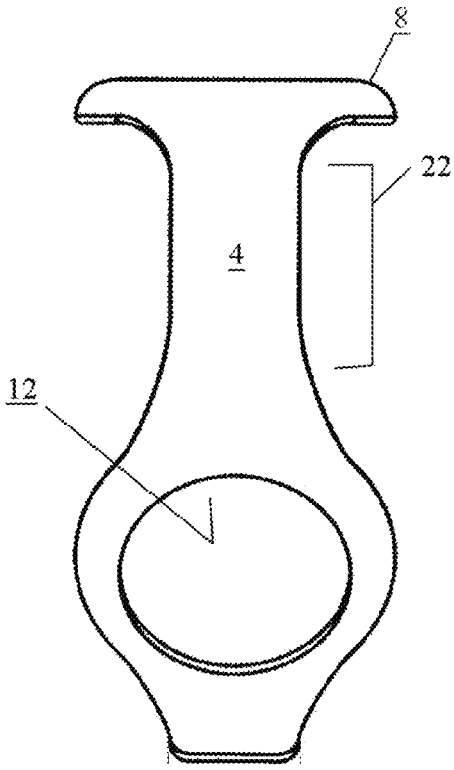
FIG. 4 is a side view of the decorative bracelet 4 as in FIG. 3 rotated 90 degrees.
Figure 5:
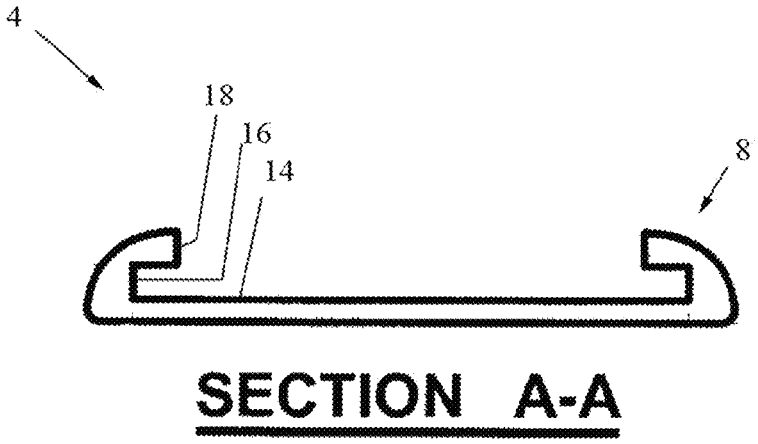
FIG. 5 is a side cross-section of one receptacle 10 of the decorative bracelet 4 taken along lines A-A of FIG. 3.

As seen in FIGS. 3-5, each circular face 8 is defined by a recessed circular receptacle 12 defining an open-faced cavity bounded by a solid back wall 14, sidewalls 16 and overhanging lip 18.

With reference to FIG. 5, the overhanging lip 18 is flexibly joined orthogonally to the sidewalls 16, which are in turn flexibly joined orthogonally to the backwall 14 to define the inner cavity. Each circular face 8 of the bracelet 4 is contoured into a smaller band section 22 joining the faces 8, giving the general appearance of a watch-band having three rounded faces. The sidewalls 16 have a first diameter conforming to the diameter of the base of the tokens 6, and the overhanging lip 18 has a second smaller diameter conforming to the diameter of the top section of the tokens 8.

Figure 6:
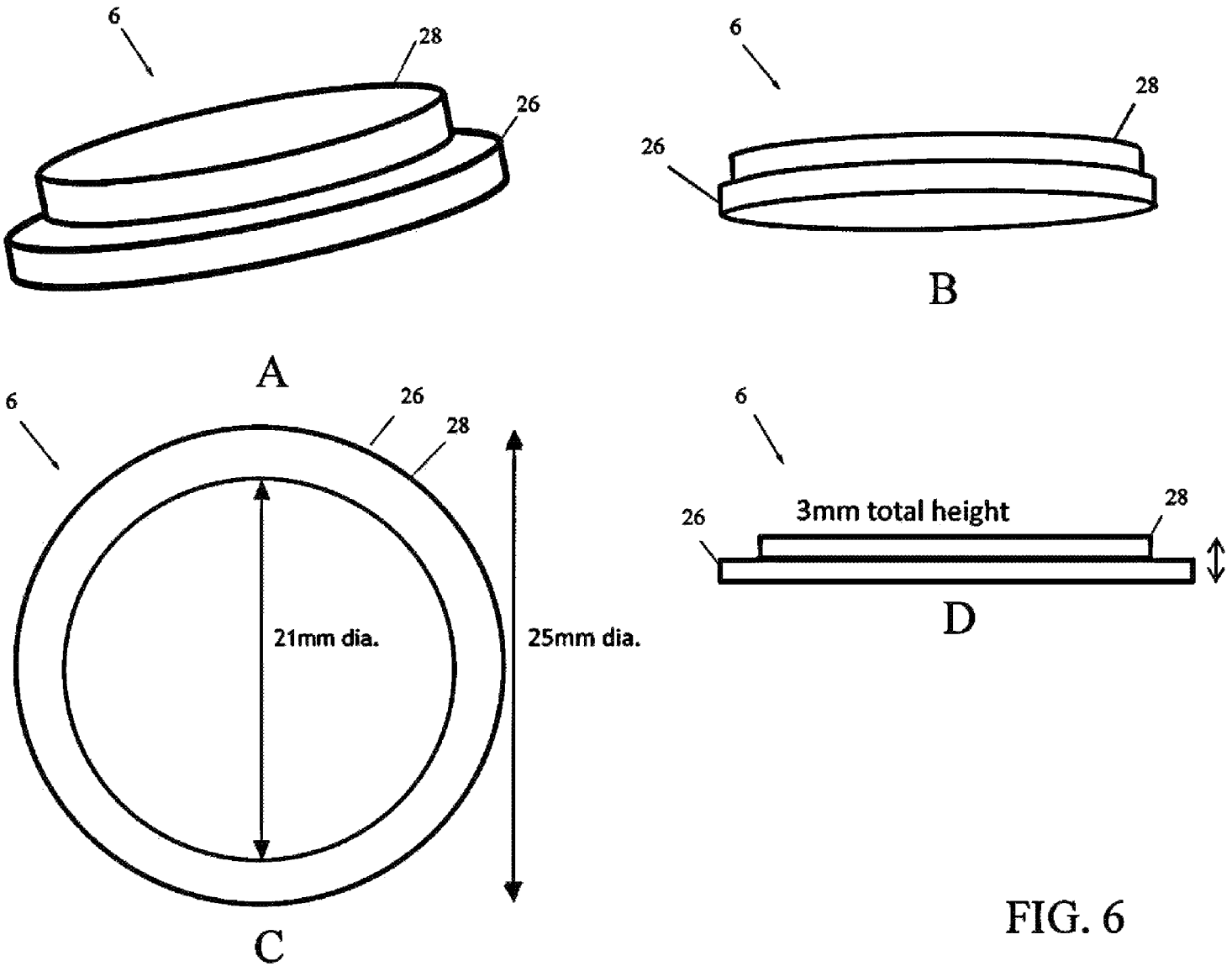
FIG. 6 (A-D) is a composite side perspective and front view of an exemplary token 6.

FIG. 6 (A-D) illustrates an exemplary one of three tokens 6, which bear different graphic indicia but all have a uniform size and circular shape, and a two-tier cross-section including a base 26 of slightly larger diameter than the top section 28. The three tokens 6 fit into the three conforming receptacles 12 in the bracelet 4 in tongue-in-groove manner, and are thereby held captive securely (but removably) within the cavities of receptacles 12.

One skilled in the art will understand that the bracelet 4 may be readily adapted for receiving fewer or more than three tokens 6, and may be adapted for alternately-shaped (non-circular) tokens without departing from the spirit or scope of the present invention. Specifically, the tokens 6 may be square, rectangular, triangular, star-shaped or oblong, and this is possible by altering the peripheral shape of the tokens 6 as well as the shapes of the conforming receptacles 12 in the bracelet 4 while maintaining the cross-sectional structure and corresponding tongue-in-groove fit for holding captive securely (but removably) within the cavities of receptacles 12. Moreover, while three tokens 6 and conforming receptacles 12 in the bracelet 4 are presently preferred, more or fewer circular faces 8 may be molded as a matter of design choice such that two, four, five, six or more tokens 6 may be seated in a corresponding number of receptacles 12. Such alterations are considered to be within the spirit and scope of the present invention.

The tokens 6 may be metallic or plastic-molded discs each bearing different graphic indicia representing an image of a certain brand logo, person, place or thing, and may contain on the back a short description of the picture (statistics, trivia, etc.). The tokens 6 have intrinsic play-value and may be traded or used to play various games in the manner of Pokémon™ or Yu-Gi-Oh™. Since the tokens are easily removable/replacable/tradable, they can be traded at will and replaced by other tokens and/or used for playing a game.

Figure 7:
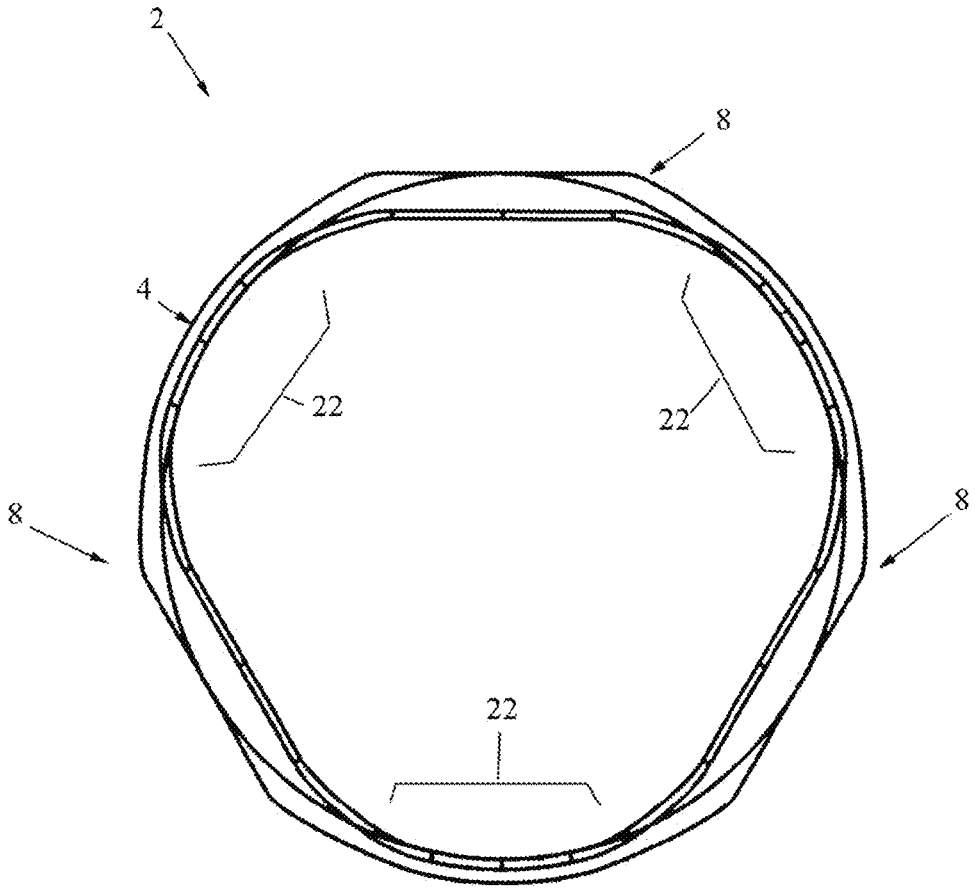
FIG. 7 is an overhead view of the decorative bracelet with tradable token insets 2.

With combined reference to FIGS. 3, 4 and 7, the outward-facing edges 20 bounding the junction of the back wall 14, sidewalls 16 and overhanging lip 18 of each receptacle 12 is molded with a curvilinear contour defining a rounded outer margin of each receptacle 12 so as to present a smooth flush appearance with the token 6 when held captive in the cavity of receptacle 12. The circular shape of the tokens 6 and receptacles 12 allows rotation of the tokens 6 within the bracelet 4 and hence reorientation of the graphic design as desired by the wearer.

One skilled in the art should understand that the token-carrying functionality of the bracelet 4 coupled with its ornamental token-displaying appearance capitalizes on the popularity of conventional rubber wristbands as well as social trading interaction, resulting in great appeal to teens and youth.

The above-described embodiment is for the purpose of promoting an understanding of the principles of the invention. It should nevertheless be understood that no limitation of the scope of the invention is thereby intended, such alternations and further modifications in the illustrated device, and such further applications of the principles of the invention as illustrated herein being contemplated as would normally occur to one skilled in the art to which the invention relates.

We claim:

1. A decorative bracelet with tradable token insets, comprising:

a plurality of tokens all having uniform size and uniform shape with two-tier cross-section including a base and an integral top section, the base being of slightly larger diameter than a top section, and each bearing different graphic indicia on a surface of said top section; and a molded silicone rubber bracelet formed with a plurality of uniformly-spaced receptacles for seating and retaining a corresponding plurality of said plurality of tokens, each said receptacle defining an open-faced cavity corresponding to the uniform shape of said plurality of tokens and bounded by a solid back wall, sidewalls having a first diameter conforming to the diameter of the base of the tokens, and an overhanging lip having a second smaller diameter conforming to the diameter of the top section of the tokens, the overhanging lip being flexibly joined orthogonally to the sidewalls, and the sidewall being flexibly joined orthogonally to the backwall to define said inner cavity;

whereby said plurality of tokens may be removably held captive in the plurality of conforming receptacles of the bracelet in tongue-in-groove manner.

2. The decorative bracelet according to claim 1, wherein said plurality of tokens all have a uniform circular shape and size.

3. The decorative bracelet according to claim 1, wherein said plurality of tokens seat flush within said molded silicone rubber bracelet with only said surface of said top section visible.

4. The decorative bracelet according to claim 1, wherein said molded silicone rubber bracelet is formed with three uniformly-spaced receptacles for seating and retaining three of said plurality of tokens.

5. The decorative bracelet according to claim 1, wherein said molded silicone rubber bracelet is formed with four uniformly-spaced receptacles for seating and retaining four of said plurality of tokens.

* * * * *